US006067662A

United States Patent [19]

Sim

[11] Patent Number: 6,067,662

[45] Date of Patent: May 30, 2000

[54] ADJUSTABLE BELT FASTENER WITH SPRING BIASED BUCKLE MEMBER

[76] Inventor: Jae Kwon Sim, 34 Jacalyn Dr., Havertown, Pa. 19083

[21] Appl. No.: 09/041,137

[22] Filed: Mar. 12, 1998

[51] Int. Cl.[7] ..... A41F 9/00

[52] U.S. Cl. ..... 2/339; 2/322; 2/338; 24/173; 24/191

[58] Field of Search ..... 2/322, 319, 338, 2/339, 324, 336; 24/191, 173, 615, 616

[56] References Cited

U.S. PATENT DOCUMENTS

| | | | |
|---|---|---|---|
| 1,213,109 | 1/1917 | Kilstrom | 2/24 |
| 3,466,668 | 9/1969 | Ochiai | 2/322 |
| 4,669,155 | 6/1987 | Chen | 24/170 |
| 4,733,440 | 3/1988 | Ogawa | 24/170 |
| 5,572,747 | 11/1996 | Cheng | 3/332 |
| 5,579,563 | 12/1996 | Sim . | |
| 5,588,184 | 12/1996 | Chen | 24/170 |
| 5,588,186 | 12/1996 | Ko | 24/585 |
| 5,749,127 | 5/1998 | Hsich | 24/3.13 |

*Primary Examiner*—John J. Calvert
*Assistant Examiner*—Tejash D Patel

[57] ABSTRACT

A fastener for a belt includes a buckle member adapted to be attached to a first end portion of the belt, wherein the buckle member includes a receiving member having an opening for receiving the belt therethrough, an operating plate provided with a tongue and pivotally mounted to the receiving member, the tongue extending from the operating plate toward a rear portion of the receiving member, and a fixing member pivotally fixed at the rear portion of the receiving member; and a slot member including a plurality of slots and protrusions and adapted to be formed to a second end portion of the belt, wherein the tongue is inserted into one of the slots and abutted against a substantially vertical surface of one of the protrusions by the operation of the operating plate.

21 Claims, 5 Drawing Sheets

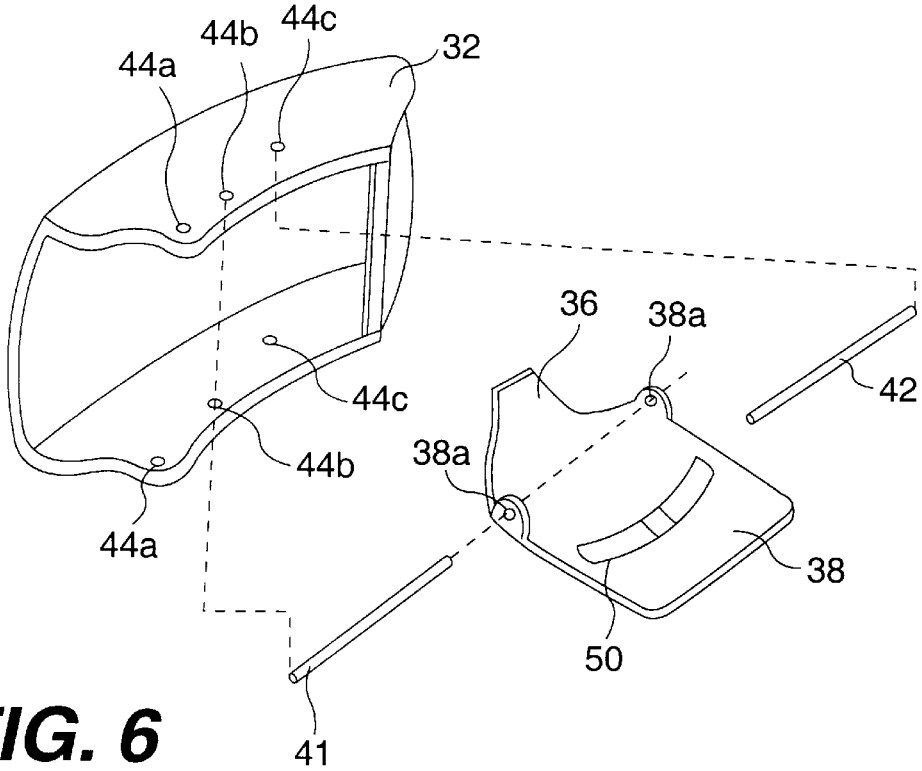
FIG. 6
FIG. 6A
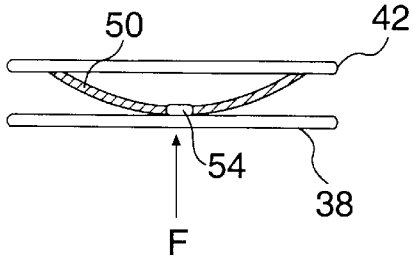
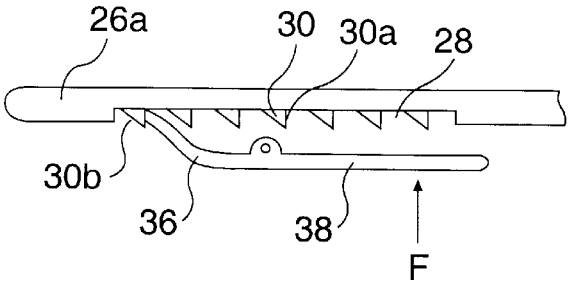
FIG. 7

ADJUSTABLE BELT FASTENER WITH SPRING BIASED BUCKLE MEMBER

BACKGROUND OF THE INVENTION

1. Field of the Invention

The present invention relates to an adjustable belt fastener and, more particularly, to an improved adjustable belt fastener including a buckle member and a slot member attached to opposite ends of a belt, the slot member containing a series of slots and the buckle member having a spring biased tongue for selectively engaging in one of the slots depending upon the desired length of the belt.

2. Description of Related Art

Various types of adjustable belt fasteners are known in the art. Such conventional adjustable belt fasteners suffer from a number of problems such as, for example, they are difficult to lock in and unlock from both ends of the belt because the locking pin is not firmly engaged since the pin can readily break away from the bore. Furthermore, such conventional fasteners are complicated in structure, expensive to manufacture, difficult to use, and readily break away from the belt.

In order to avoid such problems, U.S. Pat. No. 5,579,563, issued to the present Inventor, discloses an adjustable belt fastener including a male fastener member adapted to be attached to one end portion of a belt, the male fastener member including a spring biased operating plate provided with a tongue member, and a female fastener member adapted to be attached to the other end portion of the belt, the female fastener member including a plurality of slots for selectively receiving the tongue member of the spring biased operating plate.

FIG. 1 shows a perspective view of the adjustable belt fastener of U.S. Pat. No. 5,579,563 and FIG. 1A shows an operation of the belt fastener of FIG. 1.

As shown in FIG. 1, the adjustable belt fastener includes a male fastener member 8 and a female fastener member 10 attached to end portions 5*a*, 5*b* of a belt 5. The female fastener member 10 has a plurality of slots 3 attached to one end portion 5*b* of the belt 5 for selectively receiving a tongue 2 extending from an operating plate body 7 of the male fastener member 8. The operating plate body 7 is pivotally moved by a spring 9 to engage the tongue 2 into the slot 3. Here, the tongue 2 is positioned at the front portion of the male fastener member 8.

Once the tongue 2 is inserted into the appropriate slot 3, the tongue 2 is hooked around a right-angled protrusion 3*a*, as shown in FIG. 1A. However, since the tongue 2 hooks around the protrusion 3*a* and the pressing portion of the operating plate body 7 is positioned in the middle of the male fastener member 8, the tongue 2 can be accidentally or inadvertently released from the slot 3 when a force is pressed upon the operating plate body 7 in the direction indicated by arrow P as shown in FIG. 1A.

SUMMARY OF THE INVENTION

Accordingly, it is an object of the present invention to provide an adjustable belt fastener, which eliminates problems and disadvantages encountered with conventional adjustable belt fasteners.

Another object of the present invention is to provide an adjustable belt fastener which includes a buckle member having a spring biased tongue for engaging with one of the slots of a slot member, the buckle and slot members being attached to both end portions of the belt.

A still further object of the present invention is to provide an adjustable belt fastener which is simple in structure, inexpensive to manufacture, durable in use, and refined in appearance.

Other object and further scope of applicability of the present invention will become apparent from the detailed description given hereinafter. It should be understood, however, that the detailed description and specific examples, while indicating preferred embodiments of the invention, are given by way of illustration only, since various changes and modifications with in the spirit and scope of the invention will become apparent to those skilled in the art from this detailed description.

Briefly described, the present invention is directed to an adjustable belt fastener which includes a buckle member adapted to be attached to a first end portion of the belt, wherein the buckle member includes a receiving member having an opening for receiving the belt therethrough, an operating plate provided with a tongue and pivotally mounted to the receiving member, the tongue extending from the operating plate toward a rear portion of the receiving member, and a fixing member pivotally fixed at the rear portion of the receiving member; and a slot member including a plurality of slots and protrusions and adapted to be formed to a second end portion of the belt, wherein the tongue is inserted into one of the slots and abutted against a substantially vertical surface of one of the protrusions by the operation of the operating plate.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 6 is an exploded perspective view of an operating plate of the adjustable belt fastener according to the present invention;

FIG. 6A show an operation of a spring in the buckle member of the belt fastener according to the present invention;

FIG. 7 is a diagrammatic sectional view showing an operation of the adjustable belt fastener according to the present invention.

DETAILED DESCRIPTION OF THE PREFERRED EMBODIMENTS

Figure 1:
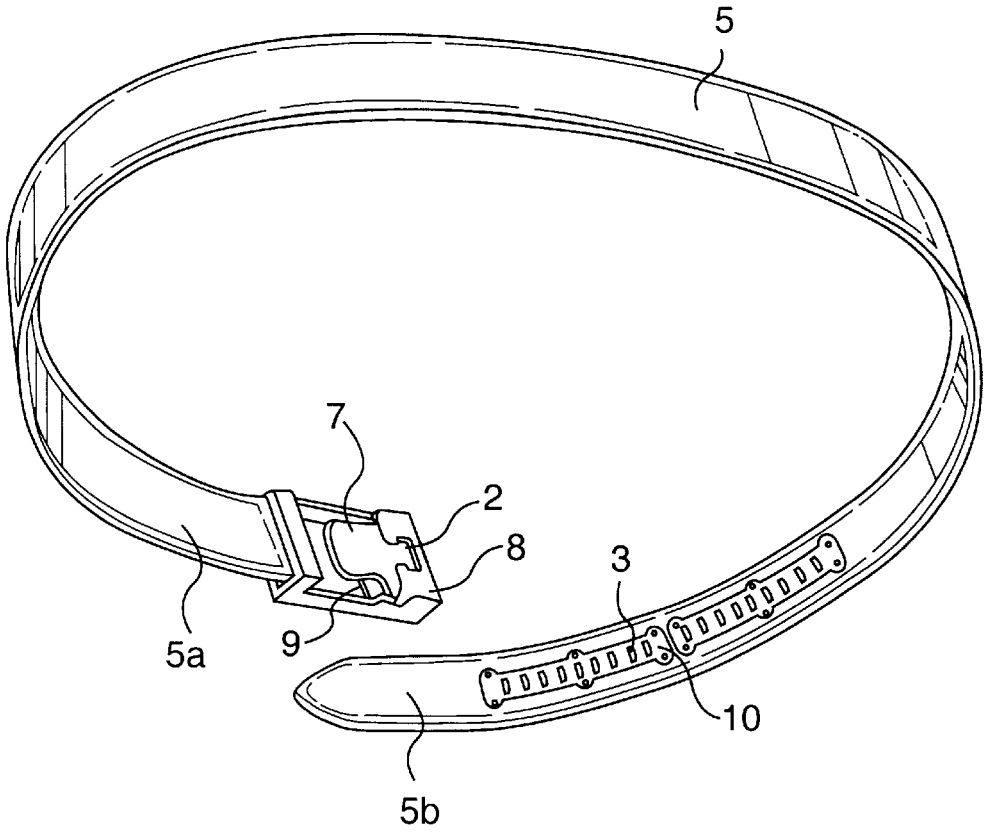
FIG. 1 CONVENTIONAL ART
FIG. 1 is a perspective view of a conventional adjustable belt fastener.
Figure 1A:
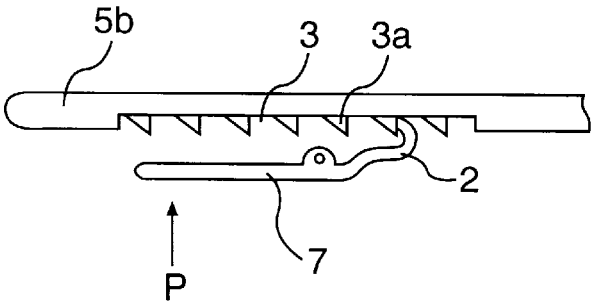
FIG. 1A CONVENTIONAL ART
FIG. 1A is a diagrammatic sectional view showing an operation of the belt fastener of FIG. 1.
Figure 2:
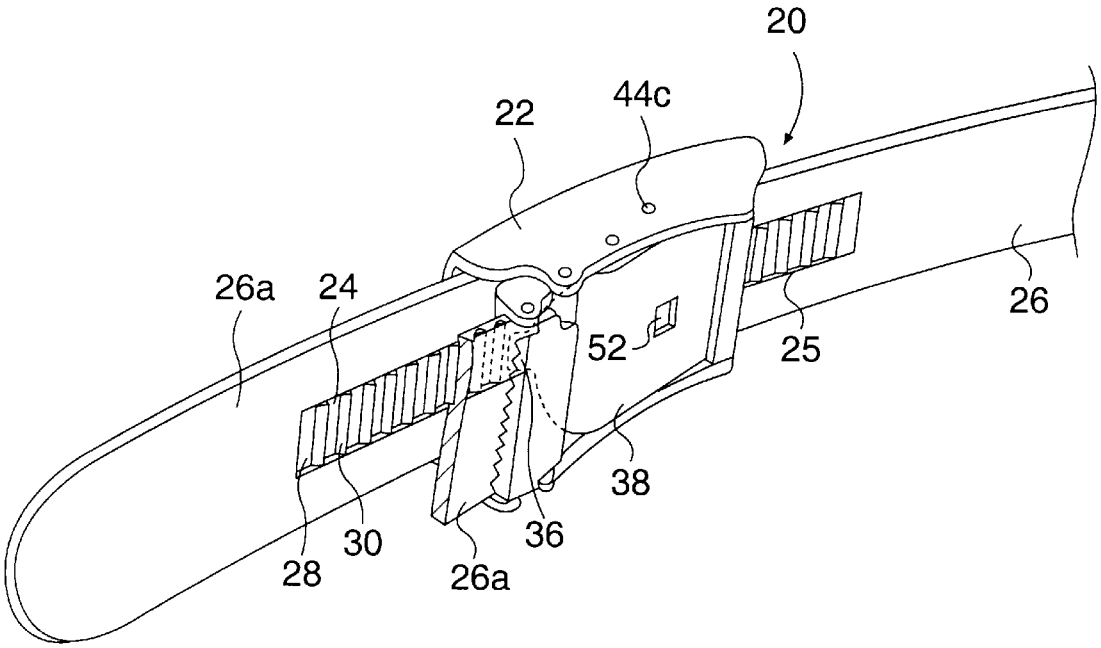
FIG. 2 CONVENTIONAL ART
FIG. 2 is an enlarged perspective view of an adjustable belt fastener attached to a belt in a locked position according to the embodiments of the present invention.
Figure 3:
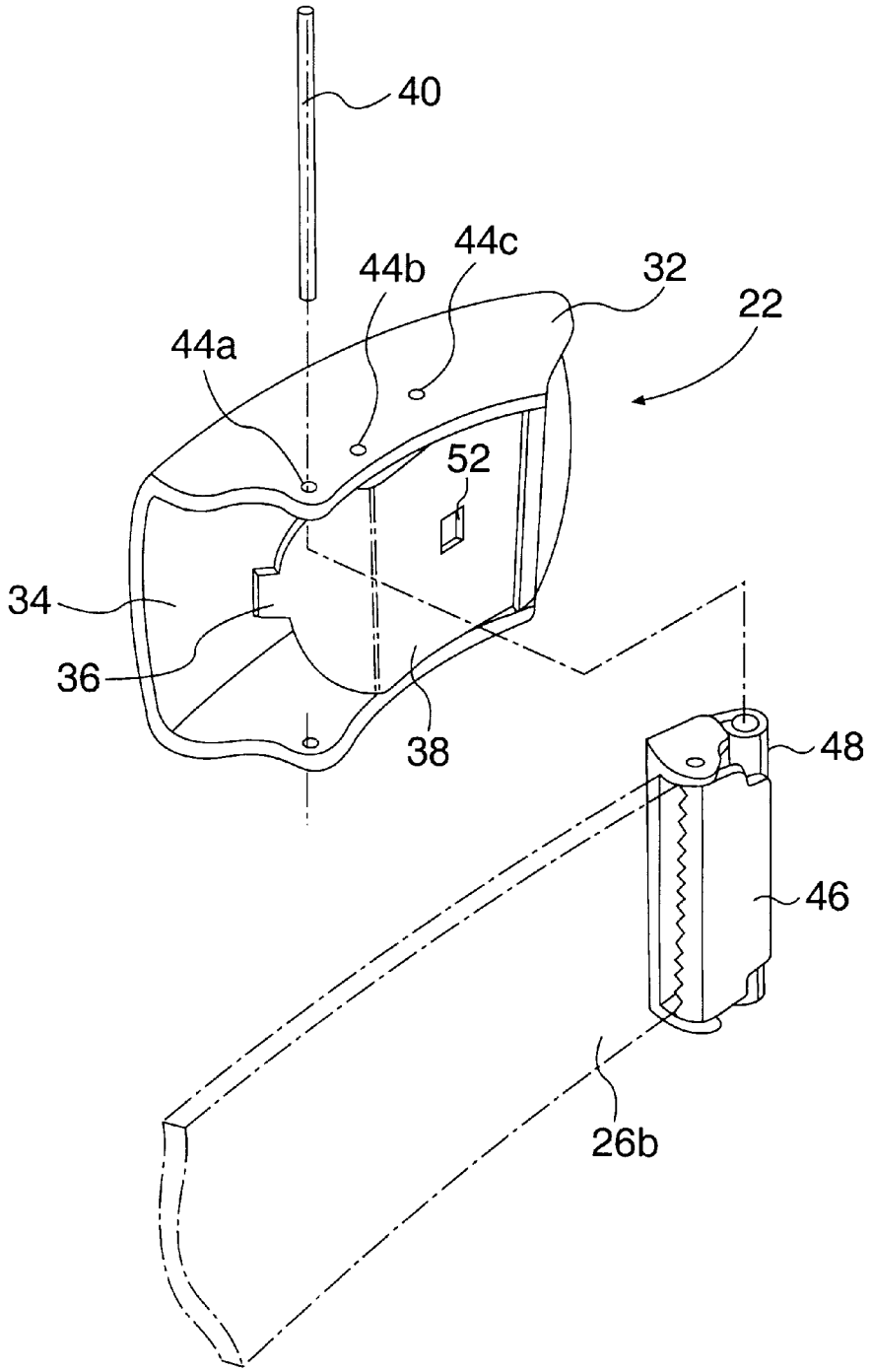
FIG. 3 is an exploded perspective view of a buckle member of the adjustable belt fastener according to the embodiments of the present invention.
Figure 4:
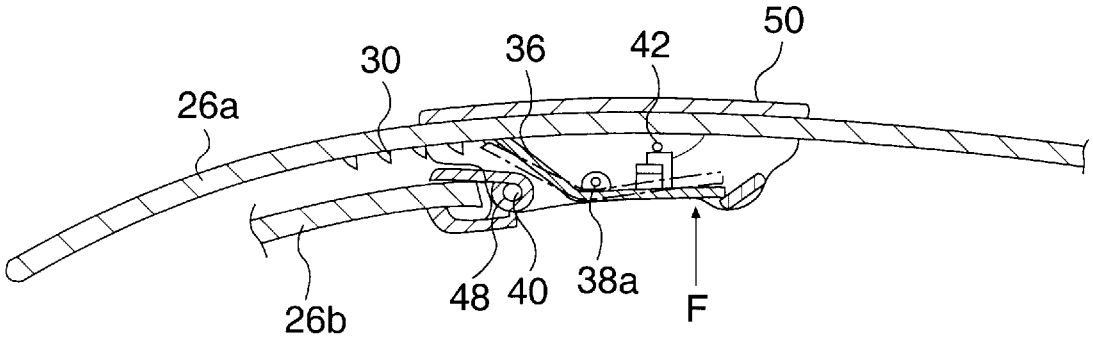
FIG. 4 is a sectional view of the adjustable belt fastener of FIG. 2.
Figure 5:
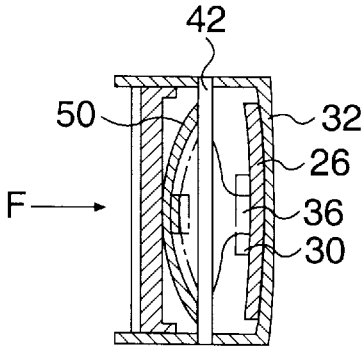
FIG. 5 is a front sectional view of the buckle member of the belt fastener of the present invention.

Referring now in detail to the drawings for the purpose of illustrating preferred embodiments of the present invention, the adjustable belt fastener 20 as shown in FIGS. 2–4, comprises a buckle member 22 interacting with a slot member 24. The buckle member 22 includes a receiving member 32 for receiving one end portion 26*a* of a belt 26 through an opening 34, a fixing member 46 fixedly attached to the other end portion 26b of the belt 26, an operating plate 38 pivotally movable in and out of the opening 34, and a tongue 36 extending from a rear end portion of the operating plate 38.

The fixing member 46 includes a support hole 48 which receives a first support 40 therein, through pin holes 44*a*. This allows the fixing member 46 to be pivotally fixed to the rear portion of the receiving member 32. The operating plate 38 may be curved so that the user can easily apply force to the operating plate 38 using a finger. For example, the operating plate 38 may be shaped so that the user can easily press the front portion of the operating plate 38 with force F, as indicated by arrow (F) as shown in FIG. 4, to pivot the operating plate 38 most effectively.

As shown in FIGS. 3 and 6, the receiving member 32 of the buckle member 22 includes pairs of first, second and third pin holes 44*a*, 44*b* and 44*c*. The first pin holes 44*a* receive a first support 40 which is inserted through the support hole 48 to pivotally connect the fixing member 46 to the rear end portion of the receiving member 32. The second pin holes 44*b* receive a second support 41 which is inserted through a pair of plate holes 38*a* of the operating plate 38, so that the operating plate 38 is pivoted around the second support 41. The third pin holes 44*c* receive a third support 42 to fix the third support 42 to the receiving member 32.

On the inner surface of the operating plate 38, a pan spring 50 is provided. The pan spring 50 has a generally curving U-configuration as shown in FIG. 6A, but other configurations are contemplated as part of the invention and the ends of the pan spring 50 are abutted against the third support 42. This allows the front portion of the operating plate 38 to elastically move in and out of the opening 34 as the force F is applied in the direction shown by the arrow in FIG. 6A. In other words, the pan spring 50 functions as a biasing member such that other biasing members can be used in lieu of the pan spring 50.

The pan spring 50 can be fixed in many different ways. For example, a central slit 52 (FIG. 3) may be provided on the operating plate 38 so that the pan spring 50 is inserted therethrough and its middle portion is exposed on the outer surface of the operating plate 38, the pan spring 50 may be fixed to the inner surface of the operating plate 38 using an attachment 54,as shown in FIG. 6A. etc. It should be understood that FIG. 6A shows one example of the pan spring 50, and other examples of the pan spring 50 or biasing member are allowed.

On the other hand, the slot member 24 as shown in FIG. 2 is provided with a recess 25 formed on the inner surface of the one end portion 26*a* of the belt 26, and includes a series of slots 28 and protrusions 30 which are equally spaced along the slot member 24. The slot member 24 may be punched into the belt 26 or may be attached using adhesives or the like. Each of the protrusions 30 is substantially a right-angled protrusion having a vertical surface 30*a* and a slant surface 30*b* as shown in FIG. 7. The tongue 36 of the buckle member 22 is inserted into one of the slots 28 and abutted against the vertical surface 30*a* of the corresponding protrusion 30.

The belt may be formed with leather, vinyl, or other known belt materials. The slot member 22 may be of the same material as the belt, or of a different material with durability. The buckle member 22 is formed with a metal or other well known buckle material.

As shown in FIGS. 2, 5, 7 and 8, the adjustable belt fastener 20 according to the present invention operates as follows.

Figure 8:
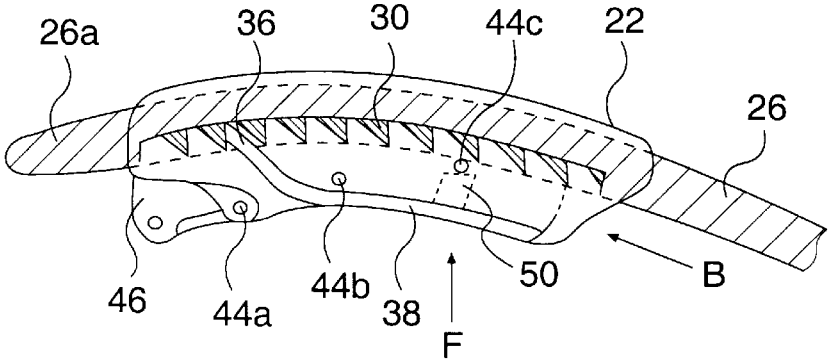
FIG. 8 is a sectional view of the adjustable belt fastener attached to a belt in a locked position according to the present invention.

The first end portion 26*a* of the belt 26 is inserted through the opening 34 of the buckle member 22 in the direction B (FIG. 8). To position the tongue 36 at the appropriate slot 28, the user can press the operating plate 38 (where the central slit 52 is located or nearby). This moves the front portion of the operating plate 38 pivotally into the opening 34 until the entire pan spring 50 is pressed against the support 42. The pivotal movement of the operating plate 38 into the opening 34 moves the tongue 36 away from the opening 34, allowing the belt 26 to move freely though the opening 34. Once the appropriate slot 28 is chosen by the user according to his or her waist size or preference, the user releases his or her finger from the operating plate 38, which causes the tongue 36 to be inserted into the appropriate slot 28 and abutted against the vertical surface 30*a* of the adjacent protrusion 30. If the user wishes to adjust the belt 26 again, the user just needs to operate the operating plate 38 as discussed above.

According to the present invention, the tongue 36 is positioned at the back (rear) portion of the buckle member 22 and extends directly to the vertical surface 30*a* of the protrusion 30 (instead of around the protrusion as in the conventional art), any inadvertent release of the tongue 36 from the abutting surface of the protrusion 30 is prevented, minimizing embarrassment and inconvenience. Further, the operating plate 38 is designed to receive force at its front portion and has a configuration which is more immune to accidental forces. This also prevents inadvertent release of the tongue 36. Moreover, the adjustable belt fastener of the present invention is reliable, simple in structure, and easy to operate for people of all ages and physical conditions.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fastener for a belt, comprising:

a buckle member adapted to be attached to a first end portion of the belt, said buckle member including, a receiving member having an opening for receiving the belt therethrough, a unitary operating plate provided with a tongue and having an inner side that faces the belt when the belt is inserted into the receiving member, the operating plate pivotally mounted to said receiving member, said tongue extending from said operating plate toward a rear portion of said receiving member, a biasing member attached to the inner side of the operating plate for biasing said operating plate toward and away from said opening of said receiving member, and a fixing member pivotally coupled at the rear portion of said receiving member; and a slot member including a plurality of slots and protrusions and adapted to be formed to a second end portion of the belt, said tongue inserted into one of said slots and abutting against a substantially vertical surface one of said protrusions by an operation of said operating plate.

2. The fastener of claim 1, wherein the biasing member is a spring (mounted to the inner side of said operating plate for biasing said operating plate toward and away from said opening of said receiving member).

3. The fastener of claim 2, further comprising:

a support fixed to said receiving member and abutting against at least one end of said spring.

4. The fastener of claim 2, wherein said spring has a substantially U-configuration.

5. The fastener of claim 2, wherein said spring is a pan spring.

6. The fastener of claim 2, wherein said operating plate includes a slit through which said spring is exposed to an outer surface of said operating plate.

7. The fastener of claim 1, further comprising:

a first support fixed to said receiving member and pivotally coupling said fixing member to said receiving member.

8. The fastener of claim 7, further comprising:

a second support fixed to said receiving member and pivotally coupling said operating plate to said receiving member.

9. The fastener of claim 8, wherein the biasing member is a spring mounted on the inner side of said operating plate for biasing said operating plate toward and away from said opening of said receiving member.

10. The fastener of claim 9, further comprising:

a third support fixed to said receiving member and abutting against at least end portions of said spring.

11. The fastener of claim 1, wherein said protrusions of said slot member are substantially right-angled protrusions.

12. The fastener of claim 1, wherein said protrusions and said slots are substantially equally spaced along said slot member.

13. The fastener of claim 1, wherein one end of said slot member is formed on an inner surface of the second end portion of the belt.

14. The fastener of claim 1, wherein said tongue is positioned within a rear portion of said buckle member.

15. The fastener of claim 1, further comprising:

a support member, fixed to said receiving member, for abutting against at least one end portion of said biasing member.

16. A fastener for a belt, comprising:

a buckle member adapted to be attached to a first end portion of the belt, said buckle member including, a receiving member having an opening for receiving the belt therethrough, an operating plate provided with a tongue and pivotally mounted to said receiving member, said tongue extending from said operating plate toward a rear portion of said receiving member, and a fixing member pivotally coupled at the rear portion of said receiving member;

a slot member including a plurality of slots and protrusions and adapted to be formed to a second end portion of the belt, said tongue inserted into one of said slots and abutting against a substantially vertical surface one of said protrusions by an operation of said operating plate; and a pan spring formed on an inner surface of said operating plate for biasing said operating plate toward and away from said opening of said receiving member.

17. The fasterner of claim 16, wherein the pan spring has a rectangular shape.

18. The fastener of claim 16, wherein the pan spring has a curved configuration.

19. A fastener for a belt, comprising:

a buckle member adapted to be attached to a first end portion of the belt, said buckle member including, a receiving member having an opening for receiving the belt therethrough, an operating plate provided with a tongue and pivotally mounted to said receiving member, said tongue extending from said operating plate toward a rear portion of said receiving member, and a fixing member pivotally coupled at the rear portion of said receiving member;

a slot member including a plurality of slots and protrusions and adapted to be formed to a second end portion of the belt, said tongue inserted into one of said slots and abutting against a substantially vertical surface one of said protrusions by an operation of said operating plate;

a first support fixed to said receiving member and pivotally coupling said fixing member to said receiving member; and a second support fixed to said receiving member and pivotally coupling said operating plate to said receiving member.

20. The fastener of claim 19, further comprising:

a biasing member formed on a surface of said operating plate for biasing said operating plate toward and away from said opening of said receiving member.

21. The faster of claim 19, further comprising:

a third support fixed to said receiving member and abutting against at least a portion of said biasing member.

* * * * *